United States Patent [19]

Borg

[11] Patent Number: 4,754,744

[45] Date of Patent: Jul. 5, 1988

[54] SUPPLY SYSTEM FOR GAS BURNERS

[75] Inventor: Anders E. Borg, Tyresö, Sweden

[73] Assignee: Aktiebolaget Electrolux, Sweden

[21] Appl. No.: 24,990

[22] Filed: Mar. 12, 1987

[30] Foreign Application Priority Data

Mar. 27, 1986 [SE] Sweden ..... 8601433

[51] Int. Cl.[4] ..... F24C 3/00

[52] U.S. Cl. ..... 126/39 N; 126/39 E; 126/39 R

[58] Field of Search ..... 431/278-285; 126/39 R, 39 H, 39 N, 39 B

[56] References Cited

U.S. PATENT DOCUMENTS 1,574,940 3/1926 Sexton ..... 126/39 N
1,820,277 8/1931 Klemme ..... 126/39 N
1,962,251 6/1934 Magin ..... 126/39 N
2,993,532 7/1961 Arden et al. ..... 126/39 H

*Primary Examiner*—James C. Yeung
*Attorney, Agent, or Firm*—Alfred E. Miller

[57] ABSTRACT

In a supply system for gas burners, preferably included in a cooker top, gas is supplied to each burner via a separate gas conduit provided with a valve. The gas conduit is supplied from a main conduit which is part of the cooker top and is connected to a gas mains. The gas conduits are contained in an elongated channel, preferably made of metal. The channel is arranged so as in succession to pass all burner positions as well as an area where the valves are situated. Via a coupling each valve is connected to the main conduit and to its respective gas conduit which via a corresponding coupling is connected to the burner.

7 Claims, 3 Drawing Sheets

SUPPLY SYSTEM FOR GAS BURNERS

The present invention refers to a supply system for gas burners, preferably included in a gas range.

In a known gas range in every heating position a burner is fixedly disposed. Gas is supplied to the burner via a separate gas conduit connected to a main conduit via a gas cock situated at the front of the range. The main conduit has the shape of a tube which extends along the front edge of the range and to which all gas cocks are connected. The gas conduits leading to the burners most often have the shape of thin tubes which have been bent to a shape predetermined for each connection.

In the manufacture of gas ranges and built-in hobs in which the number of burners and their position may vary, a number of different gas tubes for the connection of the different burners must be manufactured and kept in store. The fixed mounting of the burners in the hobs also means that each hob will get a determined shape causing the need for several different types of hobs to be kept in store. Moreover, major measures must be taken when modifications are to be introduced.

The object of the invention is to remedy the drawbacks indicated and to provide a gas supply system which is flexible and which permits the position of burners and of the cocks to be varied without changes in the basic construction of the cooker tops.

The invention will now be described in detail with reference to the accompanying drawings in which FIG. 1 schematically shows a first embodiment.

FIG. 5 shows a coupling for connecting of a burner, whereas

Figure 8:
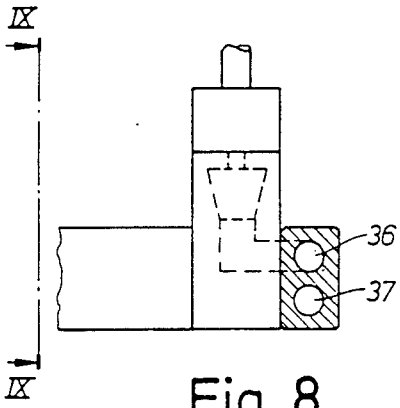
FIG. 8 is a schematic view along the line VIII-VIII in FIG. 7.
Figure 9:
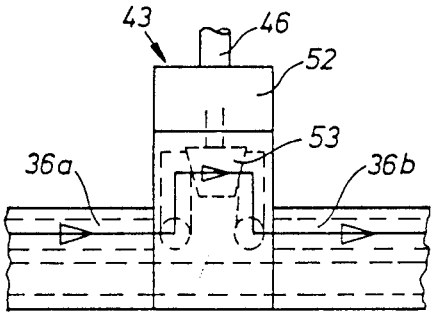

FIG. 9, finally, is a view along the line IX-IX in FIG. 8.

Figure 1:
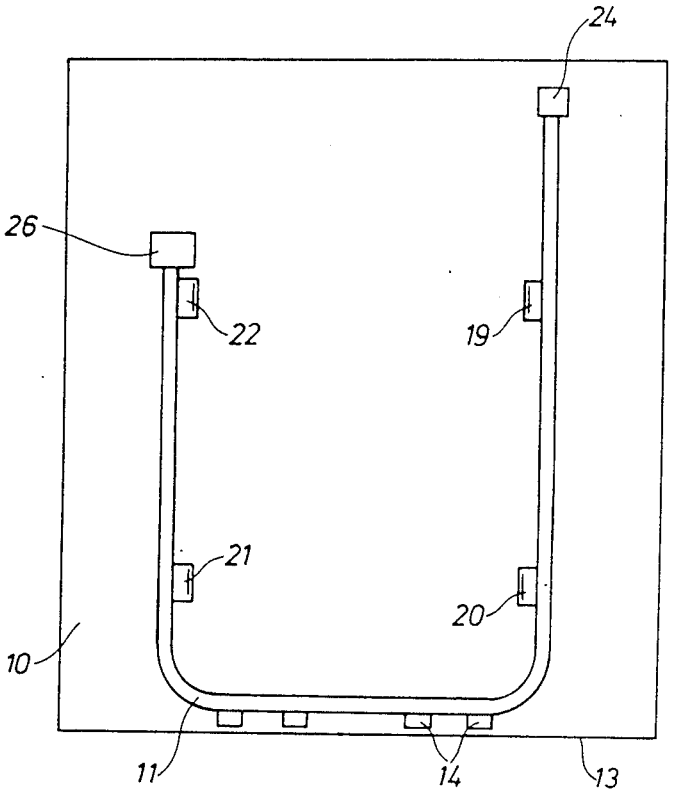
Figure 6:
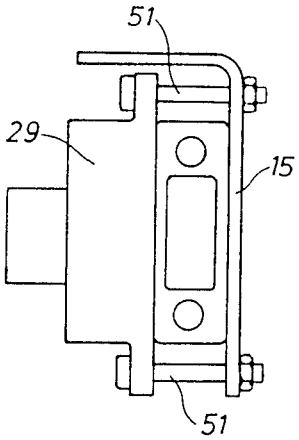
FIG. 6 illustrates a coupling for connecting of a cock.

In FIG. 1 a cooker top 10 is schematically shown as seen from above. A metal profile 11 is disposed on the upper side of the cooker top to which it is secured by means of mounting angles 12 (FIG. 2) and screws, not shown. The mounting angles can be disposed at the ends of the profile and eventually in additional positions. The profile extends along the front edge 13 of the cooker top where it is connected to a number of valves 14. The valves and the profile are together secured to an elongated mounting angle 15 (FIG. 6) which is fixed to the cooker top in a way not shown in detail.

Figure 4:
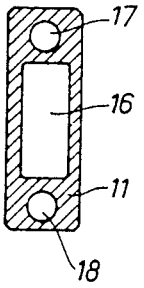
FIG. 4 shows a section through a metal profile used in the embodiment according to FIGS. 1-3 and incorporating gas conduits.
Figure 5:
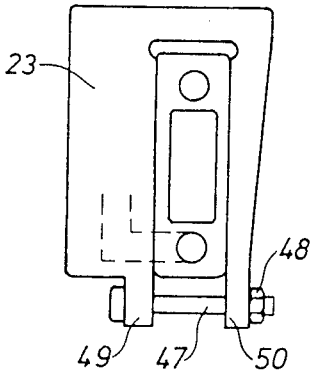

In the embodiment of FIG. 1 the metal profile or elongated channel has the section shown in FIG. 4. Thus, the profile has three conduits 16, 17, 18 of which conduit 16 is a main conduit and the conduits 17, 18 are gas conduits leading to burners schematically indicated in FIG. 1. The burners, which are designated 19, 20, 21, 22, are connected to the profile or channel via a coupling 23 shown in FIG. 5. As shown in the figure the coupling is assembled onto the profile 11 and fixed thereto by a clamp joint comprising a bolt 47 and a nut 48 which co-act with two flanges 49, 50. The burners are supported by the metal profile via the respective coupling 23.

Figure 2:
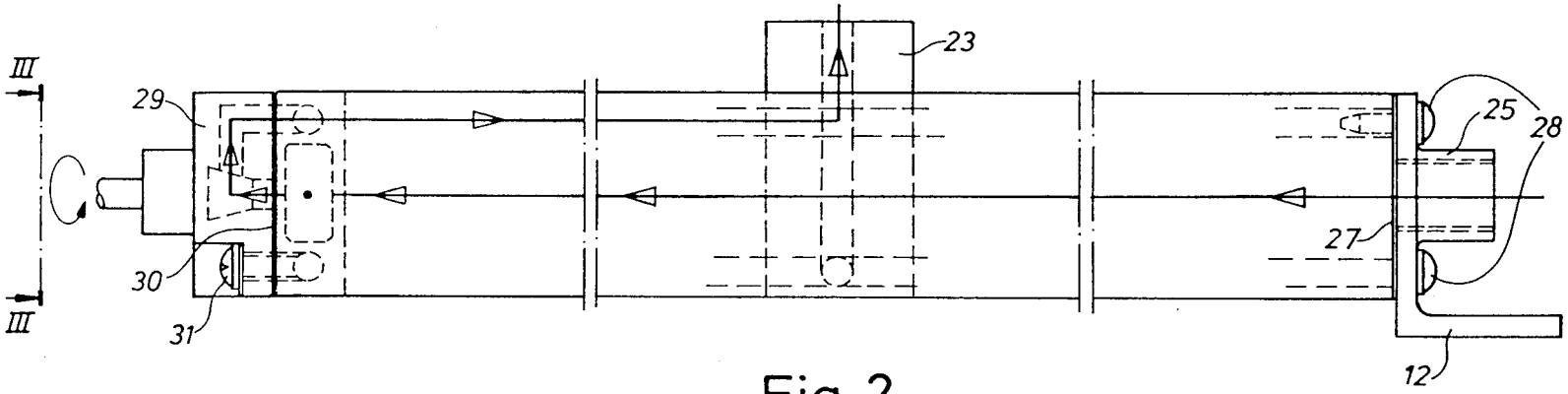
FIG. 2 is a view along the line II—II in FIG. 1 which schematically illustrates part of the gas supply system in an enlarged scale.

The conduits 16, 17, 18 extend through the whole metal profile 11, one end of which being connected to a gas mains via a schematic join 24 in the form of the mounting angle 12 shown in FIG. 2 being provided with a connecting pipe 25 for a connecting hose or the like, not shown. At the opposite end of the profile the conduits are covered by a cover 26 which can be of the same shape as the mounting angle 12, however without the connecting pipe 25. With an intermediate gasket 27 the joint 24 and the cover 26 may be secured by screws 28 being screwed into the holes of the conduits 17, 18. In FIG. 2 there is shown the connection of the cocks 14 to the metal profile 11 by a coupling 29. The coupling comprises a valve housing 29 which by screws 31 is secured to the metal profile from the side and with an intermediate gasket 30.

Figure 3:
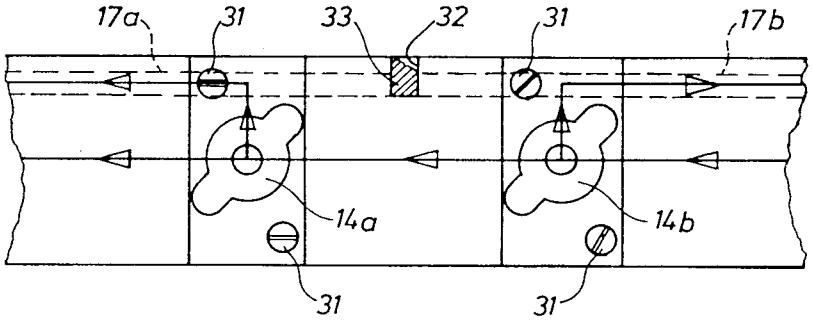
FIG. 3 is a view along the line III—III in FIG. 2 schematically illustrating a section of the system having two cocks.

As shown in FIGS. 2 and 3 gas is supplied in parallel to the valves 24 from the main conduit 16. The upper gas conduit 17 is served by a first valve 14*a* and also by a second valve 14*b*. The burners served by the valves 14a, 14b are situated at opposite sides of the valves so that with reference to FIG. 1 valve 14*a*, for example, is serving the burner 21, whereas valve 14*b* is serving the burner 20. Correspondingly, two additional valves can serve the burners 19 and 22. By the arrangement described the gas conduit is split up into two parts 17*a*, 17*b* where the conduit 17*a* leads to the burner 21 and the conduit 17*b* leads to the burner 20. The area between the conduits 17*a* and 17*b* is plugged up. For example, this can be done by making a hole 32 in the profile of a diameter slightly larger than that of the conduit 17 and then pressing a metal plug 33 into the hole.

Figure 7:
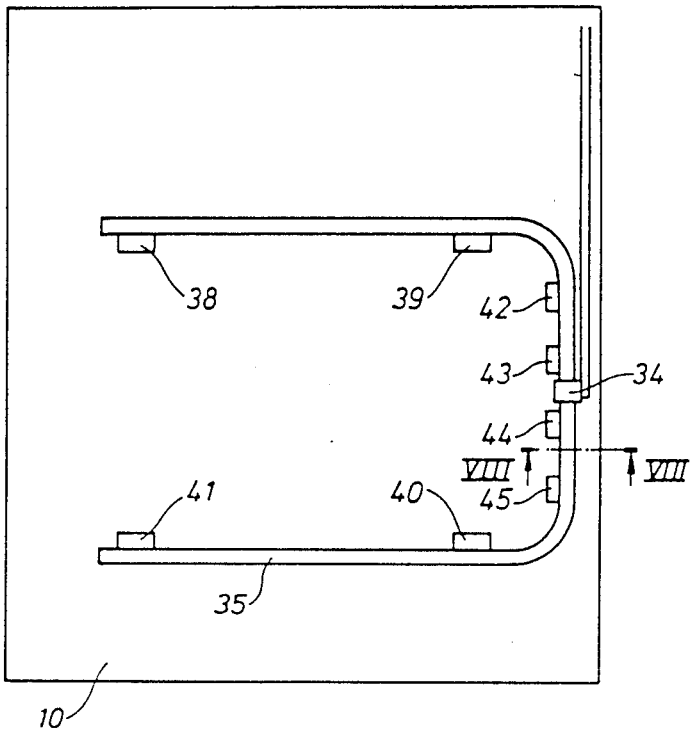
FIG. 7 illustrates a second embodiment of the gas supply system.

In the embodiment described above a gas main conduit has been integrated into the metal profile. This is not always a necessity but one can think of providing a joint 34, see FIG. 7, corresponding to the joint 24 in FIG. 1. The profile 35 has a section according to FIG. 8 having only two gas conduits 36, 37. The profile is connected to burners 38, 39, 40, 41 in a similar way as in the embodiment of FIG. 1. On the contrary, in FIG. 7 the conduits 36, 37 are directly connected to the gas mains via the joint 34. In the figure four valves 42, 43, 44, 45 are shown and the joint 34 is disposed between the central valves 43 and 44. This embodiment relates to a built-in hob and the control shafts of the valves are directed vertically, see FIGS. 8 and 9 showing the gas flow through one of the valves 42-45. For instance, the valves 43 and 44 can feed the burners 39 and 40, respectively, via the upper gas conduit 36 whereas the valves 42 and 45 can feed the burners 38 and 41, respectively, via the lower gas conduit 37. FIG. 9 shows how the gas is led from a conduit part 36*a* into a valve housing 52 via a valve plug 53 and into a gas conduit 36*b* leading to the burner 39. The space between the conduit parts 36*a* and 36*b* must be plugged up and this can be done by a fixing screw, not shown, securing the valve housing 52 to the metal profile 35. Thus, this screw can be screwed into the conduit 37 to block it up.

As appears from the embodiments described, by arranging all gas conduits in a common profile it will be possible to achieve a great flexibility because the same hob can be used for a number of different variants being equipped with only gas burners or having a mixed outfit comprising burners and electric hot plates. The profile can be made of metal or plastics and in the first-mentioned case the profile can be given its final form by bending in order to connect the different burners with their respective valves. The connection to the mains can be made at one end of the profile or in the area where the valves are situated. Preferably the different couplings for connecting of the burners and for connecting of the valves are constructed so as to permit connection to all gas conduits in the profile, whereas the profile in the respective position of a burner or a valve only has those openings which are required for the selective connection of the burner or the valve, respectively, to the desired gas conduit. Moreover, the profile has such a rigidity so as to alone easily be able to support all burners and then be secured to the cooker top by simple mounting angles.

In the drawings figures by dotted lines certain borings, or the like, have been indicated in the valve housings, in the metal profile and in the burner couplings, said borings being required for the supply of gas to the respective burner via the valve and the gas conduit. However, any detailed description of said borings will not be given. The borings or the like can be performed in many different ways and other modifications of the gas supply system can be made within the frame of the appending claims.

I claim:

1. In a gas supply system for gas burners of the type incorporated in a gas range having a main conduit and a plurality of gas conduits for separately supplying gas to each burner, and gas valves for each of the gas conduits, the improvement comprising: an elongated channel being positioned to pass in succession in proximity to each of said gas burners and said gas valve and having said gas conduits therein, and each gas valve having a first coupling means for connecting a respective valve to said main conduit and to its respective gas conduit, and a second coupling means for further connecting each of said gas conduits to a respective burner.

2. A system as claimed in claim 1 wherein said main conduit is additionally within said elongated channel.

3. A system as claimed in claim 2 wherein said conduits extend throughout the entire length of said elongated channel, and at least one end of said channel is closed.

4. A system as claimed in claim 2 further comprising a third coupling means at one end of said channel for connecting said main conduit to the gas mains.

5. A system as claimed in claim 3 wherein said gas valves are located between spaced burners, and one of said gas conduits is connected to two valves wherein part of said one gas conduit extends in one direction to form a first separate circuit serving one burner, and another part of said one gas conduit extends in another direction to form a second separate circuit serving another burner.

6. A system as claimed in claim 5 wherein said elongated channel is U-shaped.

7. A system as claimed in claim 1 wherein said first and second coupling means are arranged to permit the connection of all the gas conduits in the channel, whereas when the selected valve position and burner is made, the channel provides only those openings that are required for the selective connection of the burner to the gas conduit by means of the selected valve.

* * * * *